US006099144A

United States Patent [19]

Klaus

[11] Patent Number: 6,099,144

[45] Date of Patent: Aug. 8, 2000

[54] SOCKET FOR COMPACT FLUORESCENT BULBS

[75] Inventor: Dale A. Klaus, St. Albans, Mo.

[73] Assignee: Dal Partnership, St. Louis, Mo.

[21] Appl. No.: 09/148,082

[22] Filed: Sep. 4, 1998

[51] Int. Cl.[7] ..... F21K 2/00

[52] U.S. Cl. ..... 362/263; 362/265; 362/363; 362/404; 362/226; 439/232; 439/233; 439/356; 439/546; 313/318.01

[58] Field of Search ..... 362/263, 265, 362/147, 404, 414, 226, 363; 439/227, 231, 232, 233, 236, 558, 557, 551, 356, 353, 357, 537, 546; 313/318.01, 318.04, 318.05, 318.09

[56] References Cited

U.S. PATENT DOCUMENTS

| | | | |
|---|---|---|---|
| 4,414,489 | 11/1983 | Young . | |
| 4,738,630 | 4/1988 | Wittmann . | |
| 4,799,896 | 1/1989 | Gaynor et al. . | |
| 4,902,932 | 2/1990 | Yang . | |
| 5,015,917 | 5/1991 | Nigg . | |
| 5,073,845 | 12/1991 | Aubrey . | |
| 5,086,249 | 2/1992 | Blaisdell et al. . | |
| 5,164,635 | 11/1992 | DeJong et al. | 315/58 |
| 5,189,339 | 2/1993 | Peshak . | |
| 5,199,783 | 4/1993 | Pelton . | |
| 5,336,116 | 8/1994 | Boteler . | |
| 5,463,540 | 10/1995 | Jones . | |
| 5,545,950 | 8/1996 | Cho . | |
| 5,580,158 | 12/1996 | Aubrey et al. . | |
| 5,585,688 | 12/1996 | DeKleine . | |
| 5,716,125 | 2/1998 | Aubrey . | |
| 5,758,952 | 6/1998 | Getselis et al. | 362/260 |

*Primary Examiner*—Sandra O'Shea
*Assistant Examiner*—John Anthony Ward
*Attorney, Agent, or Firm*—Polster, Lieder, Woodruff & Lucchesi

[57] ABSTRACT

A ballasted socket which removably accepts PL type fluorescent bulbs is provided for use with lighting fixture bases. The socket includes a socket housing having a side wall, a first end wall, and a second end wall to define a chamber in which the ballast for the bulb is housed. At least one spring arm is provided to engage a slot extending from an opening in the end wall of the fixture base to snappingly mount the socket to the fixture base. In one embodiment, the socket is twist locked into the fixture base and in another embodiment, the socket is push-locked in to the fixture base.

19 Claims, 6 Drawing Sheets

SOCKET FOR COMPACT FLUORESCENT BULBS

CROSS-REFERENCE TO RELATED APPLICATIONS

This application is related to co-pending design applications Ser. No. 29/091,804 and Ser. No. 29/091,845, both of which were filed on Aug. 6, 1998, are entitled Compact Fluorescent Bulb Socket, and are incorporated herein by reference.

STATEMENT REGARDING FEDERALLY SPONSORED RESEARCH OR DEVELOPMENT

Not applicable.

BACKGROUND OF THE INVENTION

This invention relates to sockets which removably accept compact fluorescent bulbs, and in particular, to a socket which will become part of a lighting fixture in which the fluorescent bulb is inserted.

Fluorescent bulbs are well known. They generate less heat than incandescent bulbs, typically have a longer operating life than fluorescent bulbs, and typically are less expensive to operate than incandescent bulbs. Long tube fluorescent bulbs have long been used in office buildings, home basements, etc. More recently, compact fluorescent bulbs have become available for use in desk lamps, table lamps, ceiling fixtures, etc. Such bulbs are typically known as PL bulbs or lamps in the trade. A typical PL bulb is shown, for example, in U.S. Pat. No. 5,758,952.

Currently existing table lamps, ceiling fixtures, etc. include sockets which accept incandescent bulbs. To enable compact fluorescent bulbs to be used with such fixtures, manufactures have provided throw-away fluorescent bulb assemblies. In such assemblies the bulb is fixed in a base which includes the ballast or other electronics to light the bulb. The base includes a threaded end which can be screwed into an incandescent bulb socket. When the bulb bums out, or otherwise breaks, the whole unit, including the ballast is thrown away. Even though the ballast may still be operable, it is thrown away. An example of such a bulb is shown in U.S. Pat. No. 5,086,249. This type of assembly increases the cost to the consumer, because the consumer must buy the ballast with each bulb that is purchased.

Sockets have also been developed which removably receive compact fluorescent bulbs. Such sockets include the ballast for the fluorescent bulbs and overcome the extra cost to the consumer of having to purchase a ballast with each bulb that is bought. These sockets, however, also include a threaded back end so that they may be used to convert fixtures which accept incandescent bulbs to fixtures which accept fluorescent bulbs.

Fixtures (such as table lamps, ceiling fixtures, and even outdoor lighting fixtures) which are currently available are almost exclusively made for use with incandescent bulbs. I know of no sockets for PL type fluorescent bulbs which include a ballast and which can be used instead of an incandescent bulb socket in such fixture.

BRIEF SUMMARY OF THE INVENTION

A socket is provided for use with lighting fixture bases and is to be used in place of incandescent bulb sockets. The socket is adapted, as discussed below, to receive PL type fluorescent bulbs. The fixture will therefor use such fluorescent bulbs and consumers will not have to purchase adapters to use fluorescent bulbs with incandescent bulb sockets, as is currently common. The socket is a ballasted socket. That is, it includes the ballast (either a wound-coil type ballast or an electrical ballast) for the fluorescent bulb. Thus, the consumer need not purchase a ballast with each bulb, and need only replace the bulb when it bums out.

The fixture base includes an end wall having an opening with at least one slot extending radially from the opening. The fixture base can be one adapted to be mounted to a ceiling or a wall. Alternatively, the fixture base can be for an outdoor lighting fixture, and can be a post mounted fixture or a ground fixture.

The socket includes a socket housing having a side wall, a first end wall, and a second end wall to define a chamber. At least one spring arm is provided to engage the slot of the fixture base to snappingly mount the socket to the fixture base. A post extends axially from the first end wall of the socket and is surrounded by a ring. The ring and post both include end walls, the post end wall being spaced axially from the ring end wall. The post is sized and shaped to extend through the opening in the end wall of the fixture base. The ring has an outer diameter or circumference which is greater than the diameter of the fixture end base. Thus, when the socket is mounted in the fixture base, the ring end wall abuts the surface of the fixture base end wall, and the post extends through the fixture base end wall opening.

The socket opening extends inwardly from the post end wall and is sized and shaped to receive at least a portion of the base of the compact fluorescent bulb. Electrical contacts are positioned on the socket to be in electrical contact with the bulb contacts when the bulb base is received in the socket opening. As noted, a ballast is positioned in the socket housing chamber and is electrically connected to the socket contacts.

In one embodiment, the socket includes at least one ear extending outwardly from the post side wall. The ear is sized and shaped to extend through the slot of the fixture base opening. The bottom of the ear is spaced from the ring end wall. The spring arm extends from the ring generally adjacent the side wall of the post and is parallel to the end wall of the ring. The spring arm has a fixed end, a free end, and a head at the free end. The head is sized to be received in the slots of the fixture base end wall and is shaped to create an interference fit with the slot when the head is received in the slot. The spring arm head is offset from the post ear, preferably by about 90°. In this embodiment, the socket is twist locked into the fixture base. The socket is aligned with the fixture base opening such that the ears are aligned with slots in the fixture base opening. The socket is passed through the fixture base opening until the ring end surface engages the fixture base end wall. The socket is then rotated or twisted until the arm heads spring into the slots in the fixture base opening.

In a second embodiment of the socket, the spring arms extend from the ring end wall, generally parallel to the axis of the post. The spring arm includes a finger which extends over an outer surface of the base housing end wall. The bottom of the finger is spaced from the ring end wall. The finger is sized and shaped such that it will snappingly extend over the fixture base wall when the socket is applied to the fixture base.

Apart from the two mounting methods, the two embodiments are otherwise the same. For each embodiment, The socket housing includes a main portion and a cover which are matingly connected to each other. The main portion includes the socket housing first end wall and at least a part of the side wall. The cover includes the socket housing second end wall. The two portions are held together by a series of spring arms which engage a series of spring arm receptacles. The spring arms each include an outwardly directed finger and the spring arm receptacles each include a slot sized to snappingly receive the spring arm finger. A tab is spaced inwardly from the slot to be behind the arm when the cover and body are connected.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

Figure 1:
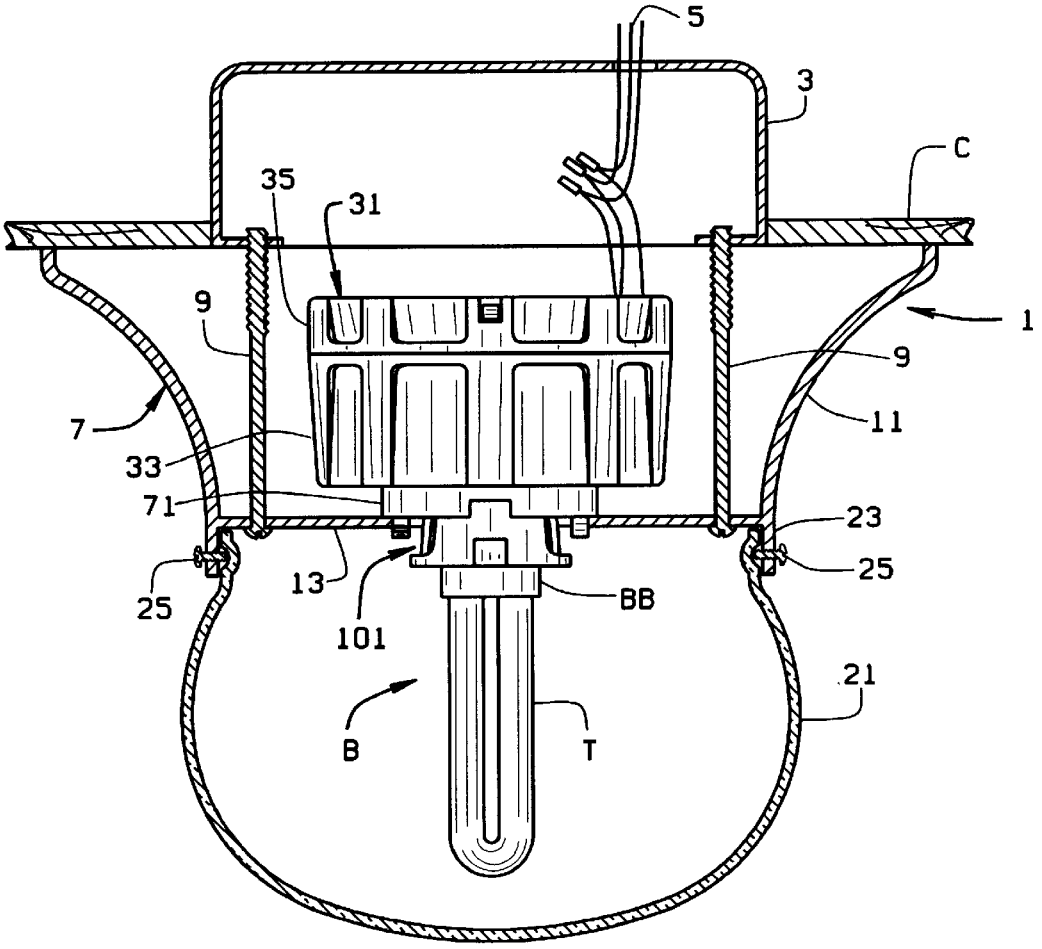
FIG. 1 is a elevational view, partly in cross-section, of a ceiling fixture having a socket of the present invention and an PL-type fluorescent bulb received in the socket.
Figure 2:
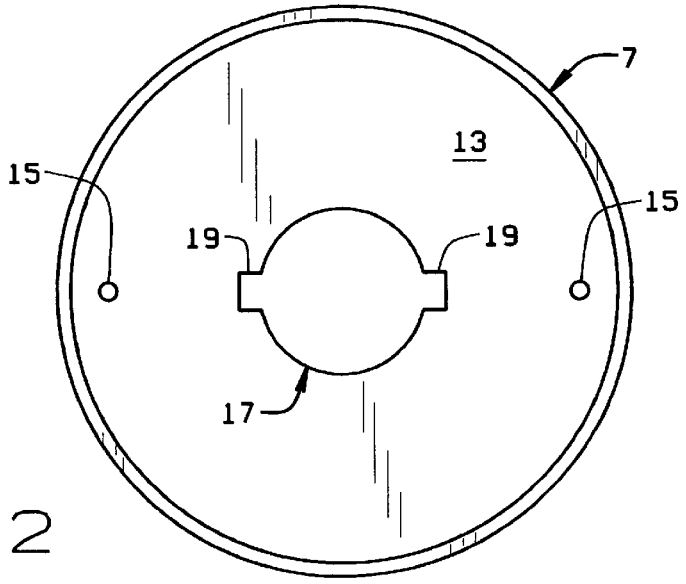
FIG. 2 is a bottom plan view of the base of the ceiling fixture.
Figure 3:
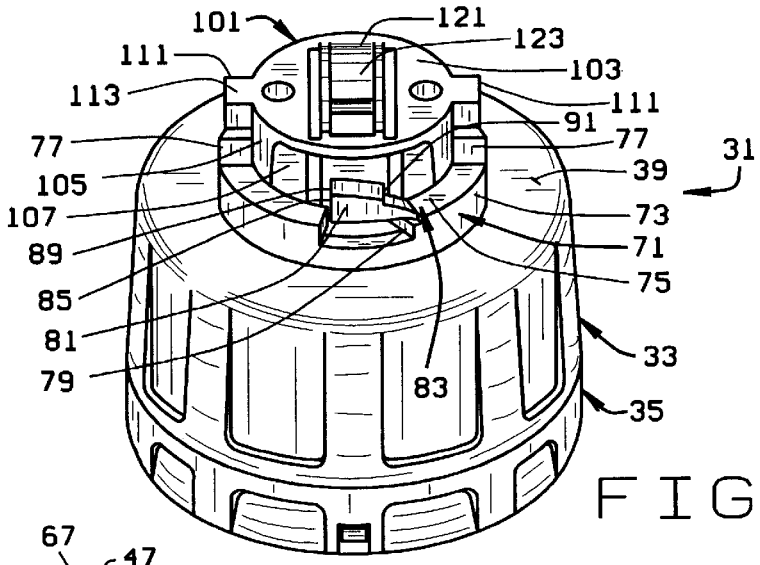
FIG. 3 is a perspective view of the fluorescent bulb socket of the present invention.

Turning to FIG. 1, a fixture 1 is mounted to a ceiling C of a room in a building. An electrical box 3 is mounted in the ceiling C. The box 3 includes electrical wires 5 which connect the box 3 to a source of electricity. A lamp base 7 is connected to the electrical box 3 by bolts 9, as is known. The lamp base 7 includes a side wall 11 and a bottom face 13. The bottom face 13 includes a pair of bolt holes 15, through which the bolts 9 extend, and a central opening 17. The central opening 17 is generally circular in shape, and has a pair of opposed slots 19 which extend out from the edge of the opening 17. As is common, the fixture 1 is adapted to receive a diffuser or cover 21. In the drawing, the base 7 has an annular lip 23 through which set screws 25 extend. The set screws 25 bear against the base of the diffuser 21, as is known, to hold the diffuser to the lamp base 7. Of course, any other conventional means can be used to attach the cover or diffuser 21 to the base. Further, the cover 21 need not be a globe, as shown, but can be any type of cover.

A socket 31 of the present invention is shown in FIG. 1 mounted in the fixture base 7. The socket 31 is provided to receive a compact fluorescent bulb. The socket 31 is to be used with the fixture 1 instead of an incandescent bulb fixture. The use of the socket 31 with the fixture 1 thus eliminates the need to retrofit an incandescent bulb fixture or to otherwise convert the incandescent bulb fixture to one which accepts fluorescent bulbs. Further, as described below, the socket 31 is provided with a ballast. Thus, ballasted fluorescent bulbs are not needed, and the consumer need not purchase an expensive ballast each time a bulb burns out or breaks.

The socket 31 is shown in detail in FIGS. 3–13. It includes a main portion or body 33 and a cover 35. The main portion includes a side wall 37 having an end surface 39 and an edge 41 opposite the surface 39. A lip 43 (FIG. 8) extends axially from the edge 41 to form a shoulder 45 at the edge 41. A plurality of spring arms 47 extend from the end of the lip 43. Preferably, there are four arms 47 evenly spaced about the circumference of the body 33. The arms 47 all have outwardly facing fingers 49. Preferably, the fingers are in the form of right triangles, with the apex of the triangle being at the end of the arm 47. Further, the fingers 49 are not as wide, from side to side, as the arms 47. A plurality of positioning tabs 51 also extend from the edge of the lip 43 between the arms 47. The tabs 51 are positioned approximately midway between the arms 47 and are shorter than the arms 47.

Figure 10:
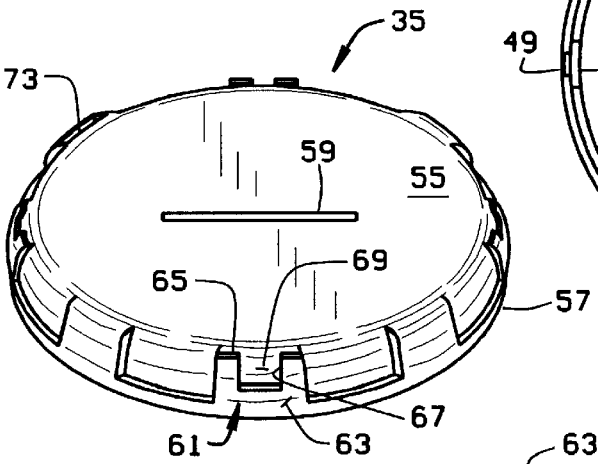
FIG. 10 is a bottom perspective of a cover for socket's main portion.
Figure 11:
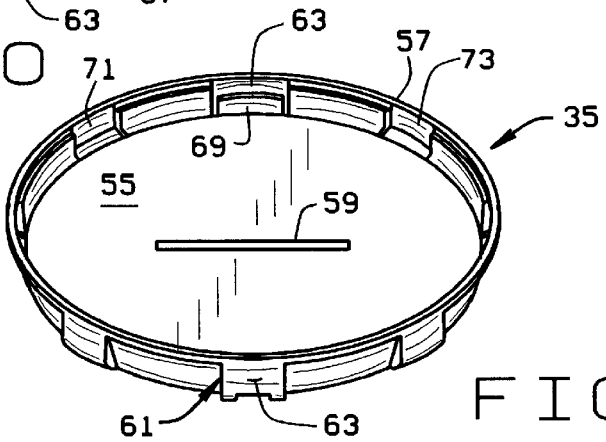
FIG. 11 is a top perspective view of the socket cover.

Turning to FIGS. 10 and 11, the cover 35 for the body includes a back surface 55 and a side wall 57. A slot 59 is formed in the back surface 55. A tool, such as a screwdriver blade, coin, etc. can be placed in the slot to facilitate rotation of the socket 31 to secure the socket in the fixture base 7, as will be described below. A plurality of receptacles 61 are formed in the side wall 57 to receive the body's arms 47 and fingers 49 to fix the cover 35 to the body 33. The receptacles 61 include an outer wall 63 which extends the height of the cover side wall 57 and is spaced radially from the side wall 57. A slot 65 is formed at the top of the receptacle wall 63 and extends the width of the wall 63. A second slot 67 extends downwardly from the slot 65. This second slot has a width and height substantially equal to the width and height of the finger 49 on the body arm 47. A rear or inner wall 69 extends downwardly from the surface 55 spaced inwardly from the receptacle wall 63. The wall 69 is sized to cover the slot 67. The space between the inner receptacle wall 69 and the outer receptacle wall 63 is slightly greater than the width of the body arm 49. Channels 71 are formed between the receptacles 61 to receive the tabs 51 of the body. Additionally, a wire slit 73 is formed between two of the receptacles 61 to allow wires to exit the socket 31 so that the socket can be connected to the wires 5.

Figure 4:
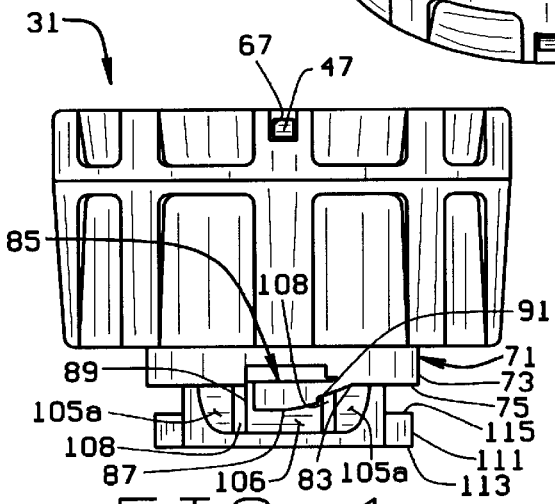
FIG. 4 is a side elevational view of the socket.
Figure 5:
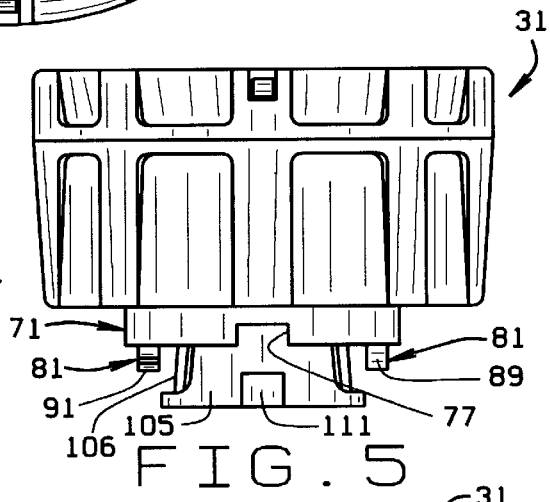
FIG. 5 is a side elevational view of the socket offset 90° from the drawing of FIG. 4.
Figure 13:
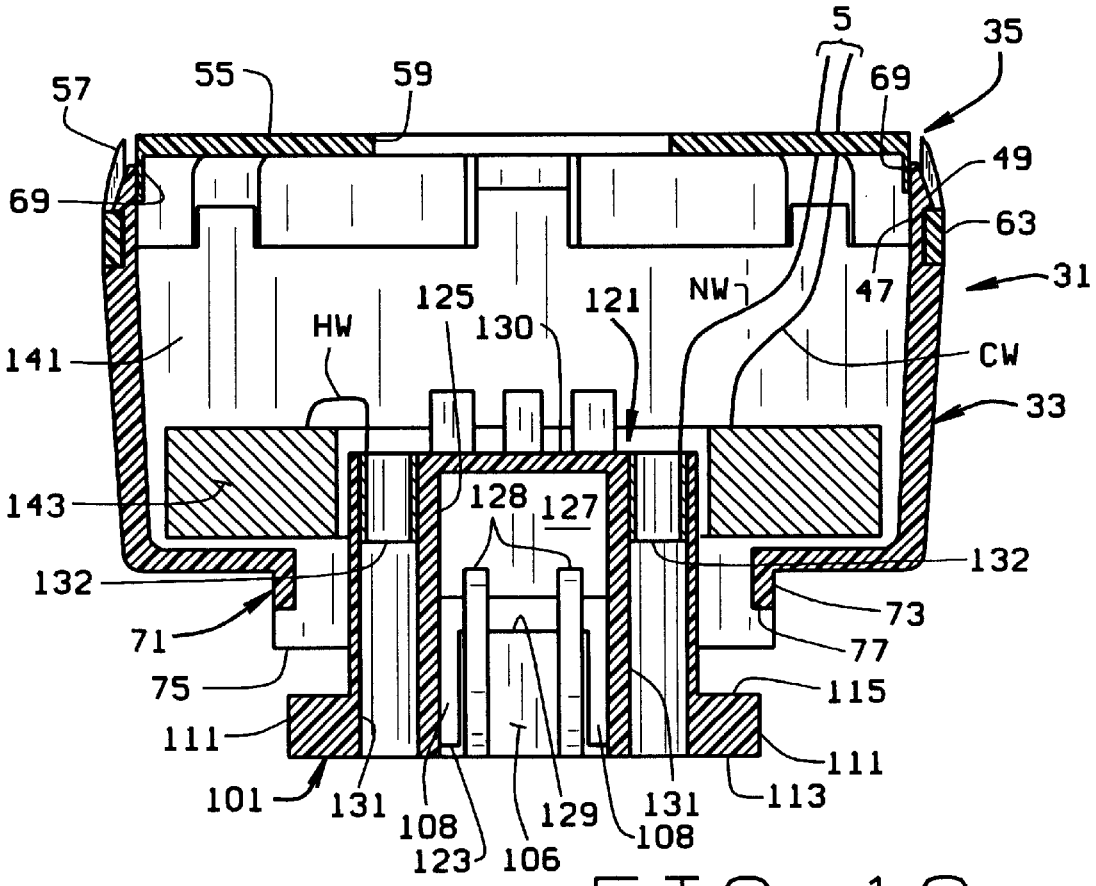
FIG. 13 is a cross-sectional view of the socket with the ballast positioned therein.

To assemble the cover 35 to the body 33, the cover and body are aligned so that the body arms 49 are aligned with the cover receptacles 61. The two parts are then squeezed together to urge the arm through the space between the inner and outer walls 69 and 63 of the receptacle. When connected, the arm fingers 49 will be captured in the slot 67, as seen in FIGS. 4 and 13. The flat of the finger 49 will engage the flat edge of the slot 67, forming an interference fit between the fingers 49 and the slot 67. Additionally, as seen in FIG. 13, the arm 47 will be sandwiched between the inner wall 69 and the outer wall 63 of the receptacle, thereby preventing radial movement of the arm once the two parts have been connected. Thus, once the body and cover are snapped together, they cannot easily be separated.

Turning to FIGS. 3–6, the socket body includes a ring 71 centered on the end wall 39. The ring 71 has a side wall 73 and an end wall 75. A pair of opposed slots 77 are formed in the ring 71. The slots 77 extend from the ring end wall 75 toward the body end surface 39, but preferably do not extend the full height of the ring wall 73. The slots 77 do, however, extend the full width of the ring wall 73.

A second pair of oppositely positioned slots 79 is formed in the ring 71. Preferably, the slots 79 are approximately midway between slots 77. The slots 79, like the slots 77, extend downwardly from the ring wall end surface 75. The slots 79 extend the width of the ring wall 73, but preferably do not extend the full height of the ring wall 73. A pair of spring arms 81 extend generally parallel to the ring end surface 75 over the second slots 79. The arms 81 have a width less then the width of the ring wall 73. The arms 81 have a fixed end 83 and a free end 85. A projection or head 87 is formed at the free end 85 of the arm. The head has a forward flat surface 89 and a rear flat surface 91. The distance between the forward and rear surfaces 89 and 91 is slightly shorter than the slots 19 in the fixture base opening 17.

A post 101 extends axially from the center of the ring 71. The post 101 has an end wall 103 which is generally circular in plan, a pair of opposed generally curved side wall portions 105 and a pair of generally flat side wall portions 107. The wall 107 is defined by a tab 106 and the edges 105*a* of the curved wall portions 105. The tab 106 is spaced from the edges 105*a* by slots 108.

Figure 6:
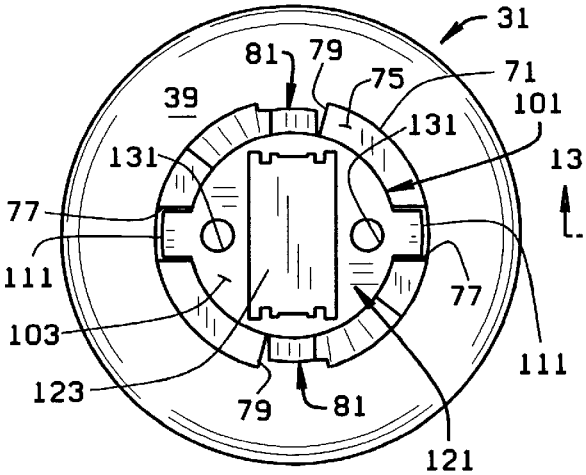
FIG. 6 is a top plan view of the socket.
Figure 7:
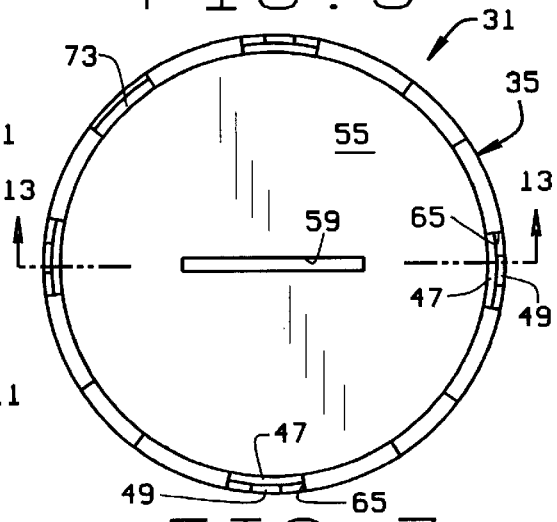
FIG. 7 is a bottom plan view of the socket.
Figure 8:
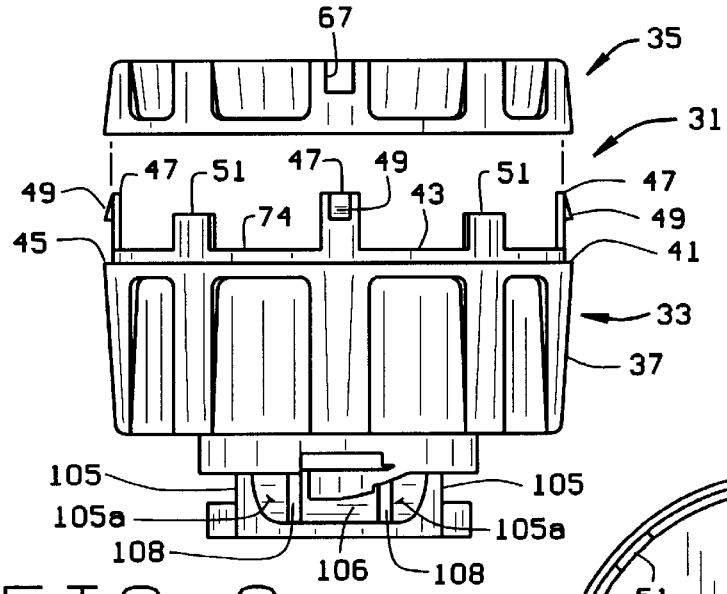
FIG. 8 is an exploded elevational view of the socket.
Figure 9:
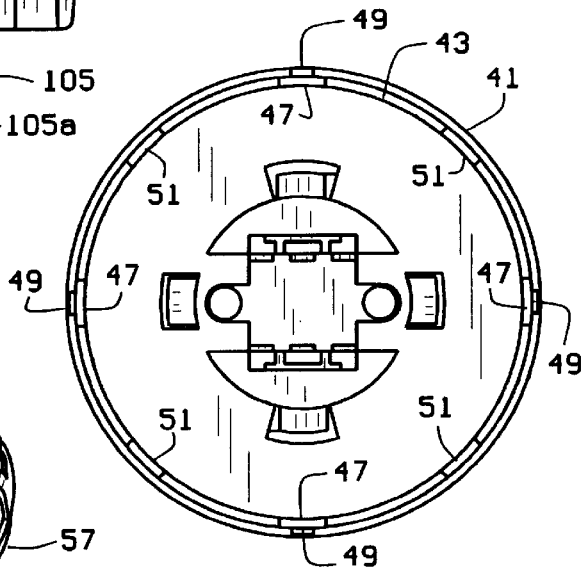
FIG. 9 is a bottom plan view of a main portion of the socket.

The spring arms 81 extend along the flat side wall portion 107 of the post 101. A pair of ears 111 extend out from the side wall portions 105. The ears have an upper surface 113 which is generally flush with the post end surface 103, and a bottom surface 115 which is spaced from the ring end surface 75. The ears 111 are positioned on the post 101 to be directly above the slots 77 in the ring, as best seen in FIGS. 6 and 13. The ears 111 are sized to fit through the slots 19 in the fixture base opening 17. The distance between the ear bottom surface 115 and the ring end surface 75 is at least slightly greater than the thickness of the fixture base end surface 13. The diameter of the post end wall 103 is slightly less than the diameter of the fixture base opening 17.

To mount the socket 31 in the base 7, the post 101 is passed through the base opening 17 from the inside of the fixture base 7, as seen in FIG. 1. The post 101 is passed through the base with the ears 111 aligned with the slots 19 until the end wall 75 of the socket ring 71 contacts or engages the inner surface of the base end wall 13. In this position, the spring arms 81 will be pressed in to the slots 79. The socket 31 is then rotated relative to the fixture base 7 until the heads 85 of the spring arms 81 come into alignment with the fixture base slots 19. When this occurs, the arms 81 will spring back to their normal position and the arm heads 85 will pass into the slot 19. The side walls 89 and 91 of the heads 85 are generally perpendicular to the fixture surface 13. As noted, the heads 85 have a length slightly less then the width of the slots 19. Thus, when the heads 85 are received in the slots, there will be an interference fit between the head walls 89 and 91 and the edges of the slot 19. Thus, the socket will not be able to be rotated relative to the fixture once it is in place. As seen in FIG. 1, when the socket is in place, the ring end wall 73 (which has a diameter greater than the diameter of the fixture base opening 17) will rest on the inner surface of the of the fixture base end wall 13. The ears 111, on the other hand, will be on the outer surface of the base end wall 13. Thus, the fixture base end wall 13 will be between the ring 71 and the ears 111. The ears 111, which will be out of alignment with the slots 19, will prevent the socket 31 from being pushed up into the fixture base 7. Therefore, the interaction of the ring 71 and the ears 111 with the base end wall 13 will hold the socket in place relative to the base against inadvertent movement of the socket.

Figure 15:
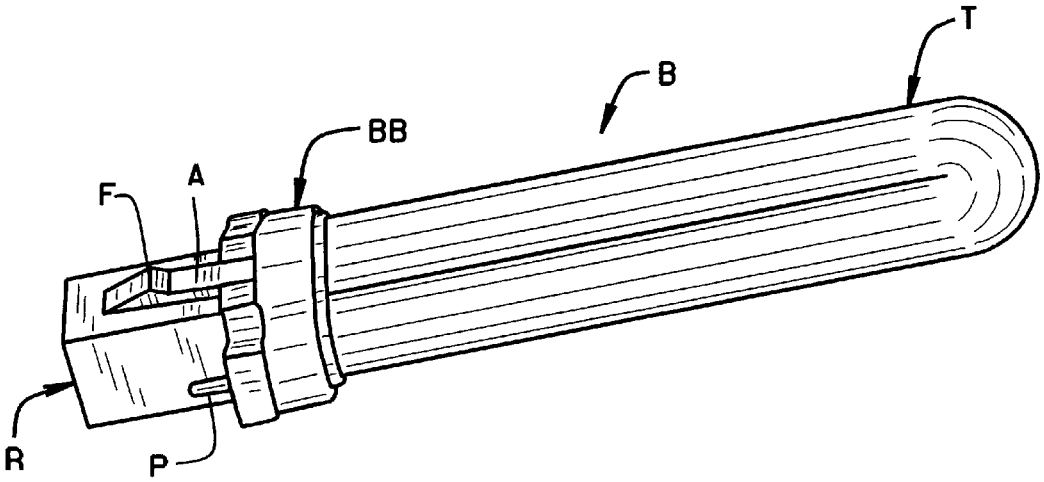
FIG. 15 is a perspective view of a typical low wattage compact fluorescent bulb which is received in the socket.

A typical compact fluorescent bulb B is shown in FIG. 15. The bulb B includes a tube portion T extending from a bulb base BB. The base BB includes a generally rectangular portion R and a pair of rearwardly extending pins P. A pair of opposing arms A with fingers F extend from the rectangular portion R. The rectangular portion R and pins P are received in a receptacle of the socket 31 as will be described below. The pins P are provided to place the tube T of the bulb B in electrical contact with a ballast housed in the socket 31. The arm fingers F engage the socket to hold the bulb B in the socket.

A receptacle 121 is formed in the post 101 and is sized and shaped to removably receive the bulb B. The receptacle includes a central opening 123 sized and shaped to receive the base BB of the bulb B. The opening is defined by a pair of opposing solid walls 125, a pair of opposing walls 127, the tabs 106, and a floor 130. The walls 127 are spaced from the tabs 106 by a gap 129, and are joined together by a pair of ribs 128. The ribs 128 extend from the end surface 103 of the post 101 to slightly below the edge of the walls 127. The two side slots 108, as noted above, are formed on opposite sides of the tab 106 and extend to the wall 127. The gap 129 is sized and shaped to co-act with the spring fingers F on the rectangular portion R of the bulb B to removably hold the bulb B in the socket opening 123.

Contact passages 131 are positioned on opposing sides of the socket opening 123. The contact passages 131 are sized and shaped to receive the pins P of the bulb B. Preferably, cylindrical contacts 132 are positioned in the contact passages 131. As discussed below, electrical wires HW and NW extend from the contacts 132 to a ballast and source of electricity. Thus, the bulb B will be in electrical communication with a source of electrical power through its pins P, the contacts 132, and the wires HW and NW, so that the will be bulb can be energized.

As seen in FIG. 13, the socket opening 123 extends into the chamber 141 defined by the socket body 33. The wall 37 of the body 33 is spaced from the receptacle 121, defining an annular channel. An annular ballast 143 is received in the annular channel. The ballast 143 includes a "hot" wire HW and a connecting wire CW. The hot wire HW extends from the ballast to one of the contacts 132. The connecting wire CW extends from the ballast to be connected to the "hot" wire in the electrical box. A neutral wire NW extends from the other contact 132 to be connected to the neutral wire in the electrical box. The wires NW and CW exit the socket 31 through the wire slot 73 in the socket cover 35. The socket 31 can also include a ground wire.

Figure 12:
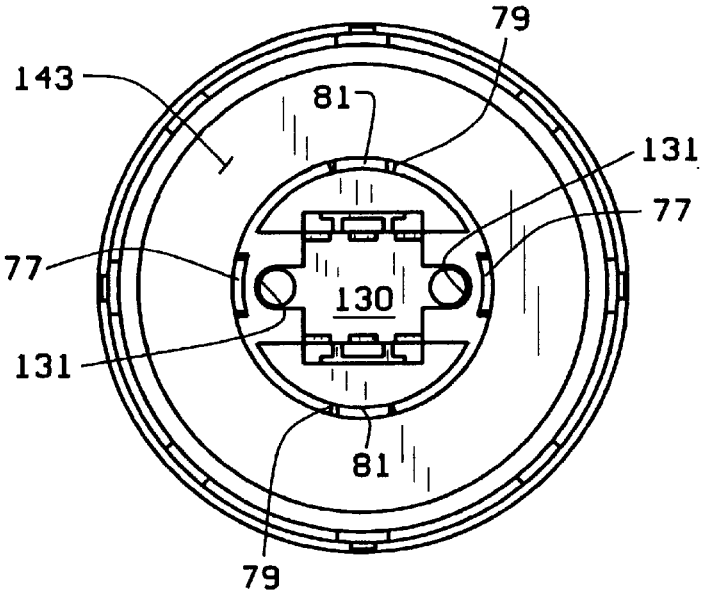
FIG. 12 is a bottom plan view of the socket's main portion with a ballast positioned therein to power the PL bulb received in the socket.

The ballast 143 shown in FIGS. 12 and 13 is a transformer type ballast, which is used with low wattage bulbs (i.e., 9 and 13 watt bulbs). The transformer ballast can be replaced with an electrical or solid state ballast for higher wattage bulbs (i.e., 18, 26, and 32 watt bulbs.) The higher wattage bulbs generally include four contacts, thus, additional contact passages would be required in the socket. The receptacle 121 does not extend the full depth of the body cavity 141. Thus, if an electrical or solid state ballast is used, the ballast could be mounted in the cavity 141 to the floor 130 of the receptacle 121. Any other conventional means could also be used to mount an electrical ballast in the socket 31.

Figure 14:
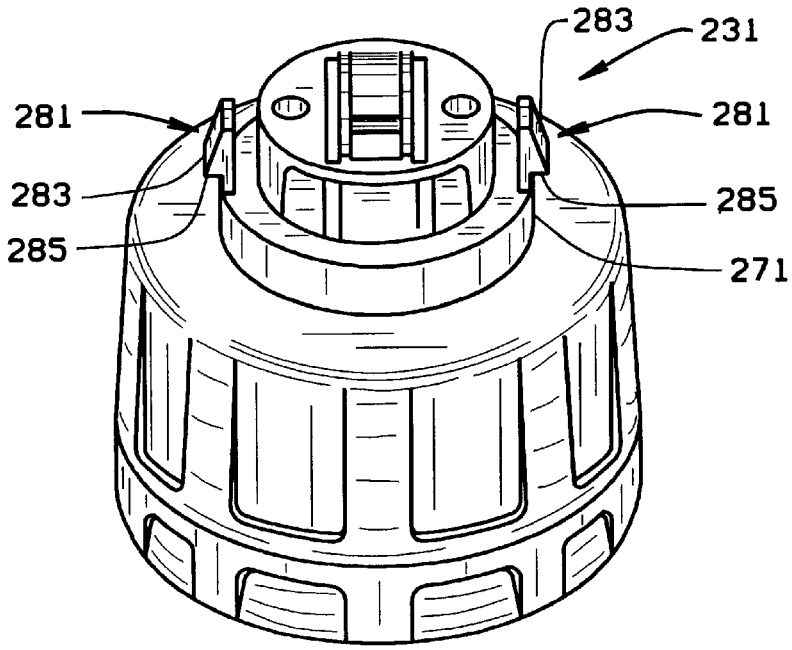
FIG. 14 is a perspective view of a second embodiment of the socket.

Turning to FIG. 14. a second embodiment of the socket is shown. The socket 231 is substantially identical to the socket 31. However, rather than having circumferential spring arms 81 which provide a twist lock action, the socket 231 includes axial extending spring arms 281 having fingers 283. The spring arms 281 are positioned where the slots 79 and ears 81 of the socket 31 are positioned. The spring arms 281 are sized to snappingly engage the slots 19 of the base opening 17 to hold the socket in the fixture base 7. The fingers 281, as can be seen, are generally right triangular, and have a flat bottom surface 285. This bottom surface 285 will extend over the outer surface of the fixture base surface 13. The surface 13 will thus be sandwiched between the ring 271 and the finger bottom surfaces 285 to hold the socket 231 in the fixture base 7.

Figure 16:
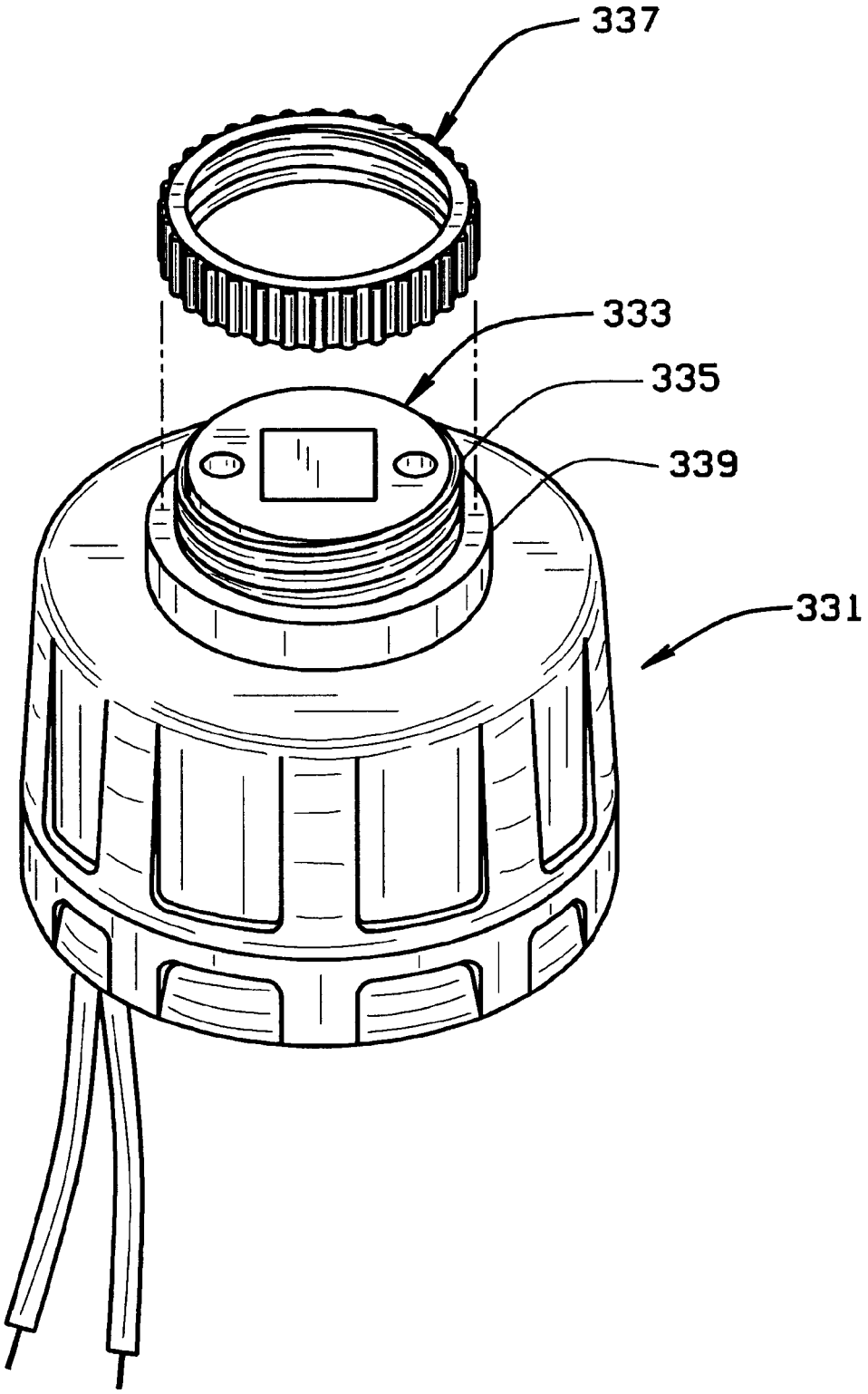
FIG. 16 is a perspective view of a third embodiment of the socket.

Turning to FIG. 16. a third embodiment of the socket is shown. The socket 331 is substantially identical to the sockets 31 and 231. However, rather than having spring arms 81 or 281 to mount the socket to the base, the socket 331 the post 333 is threaded, as at 335. The socket is provided with an internally threaded ring 337 which can be screwed onto the post. To mount the socket 331 to the fixture base 7, the post 333 is passed through the fixture base opening from within the fixture, as with the sockets 31 and 231. The threaded end of the post will extend beyond the bottom surface of the fixture base 7, to allow the ring 337 to be threaded onto the post 333. The bottom surface of the fixture base will then be sandwiched between the threaded ring 337 and the ring 339 from which the post 333 extends.

As can be appreciated, the socket of the present invention may be used to make a lighting fixture which accepts compact fluorescent bulbs. The socket is to be used in fixtures in place of incandescent bulb sockets, and thus avoid the need to use sockets which convert incandescent fixtures to fluorescent fixtures. The socket is easy to install in the fixture base, and is either twist locked in or snapped in. Further, the socket is ballasted. Thus, a ballasted PL type fluorescent bulbs need not be purchased for use with the socket of the present invention. Although the socket is described for use with ceiling fixtures, the socket can be used with any other type of lighting fixture. For example, the socket can be incorporated into an outdoor lighting fixture. Such a fixture could be mounted on a pole or a wall to direct light downwardly, or could be mounted on a post, for walk lighting for example. Examples of such outdoor lighting fixtures are shown in U.S. Pat. Nos. D417,522 and D416,347 both of which are incorporated herein by reference. In these instances, the diffuser 21 would be replaced with the cover shown in the noted applications.

In view of the above, it will be seen that the advantages of the present invention have been achieved and other advantageous results have been obtained. As various changes could be made in the above constructions without departing from the scope of the invention, it is intended that all matter contained in the above description or shown in the accompanying drawings shall be interpreted as illustrative and not in a limiting sense. For example, although the fluorescent bulb B is provided with pins P to make the electrical connection with the socket, the bulb could be provided with contacts which, for example, are positioned on the rectangular portion R of the bulb base BB. In this instance, the pin holes or contact passages 131 in the socket 31 could be eliminated, and the contacts 132 would be positioned in the socket opening 123 to engage the bulb contacts. The socket could be provided with a vent to vent heat produced by the ballast. Such a vent could be placed in any of the walls of the socket, and could be in any desired configuration. These examples are merely illustrative.

What is claimed is:

1. A ballasted socket which receives a compact fluorescent bulb, the fluorescent bulb having a tube portion, a base portion, and electrical contacts on the base portion; the socket including:

a socket housing having a side wall, a first end wall, and a second end wall, said walls defining a chamber;

a spring arm extending generally parallel to said housing first end wall; said spring arm having a fixed end and a free end and a protection on an upper surface of said spring arm near said free end; said spring arm being deflectable in a path substantially perpendicular to said socket housing end wall;

a receptacle extending inwardly from said post end wall, said receptacle being sized and shaped to receive at least a portion of the base of the compact fluorescent bulb;

electrical contacts positioned on said socket to be in electrical contact with the bulb contacts when the bulb base is received in the receptacle; and a ballast in said socket housing chamber, said ballast being electrically connected to said socket contacts.

2. The socket of claim 1 wherein the socket includes a post extending from said socket housing first end wall, said post having a post end wall and a side wall; said receptacle being in said post end wall; at least one ear extending outwardly from said post side wall, said ear having a bottom surface spaced from said socket housing first end wall.

3. The socket of claim 2 wherein said socket includes a ring on said socket housing first end wall which surrounds said post; said ring having a side wall and a ring end wall; said post end wall being spaced axially from said ring end wall; said spring arm extending from said ring generally adjacent the side wall of said post, said spring arm being generally parallel to the end wall of said ring, said spring arm having a fixed end, a free end, and a head at said free end.

4. The socket of claim 3 wherein said ear bottom surface is spaced from said ring end wall.

5. The socket of claim 3 wherein said spring arm is offset from said ear.

6. The socket of claim 5 wherein said spring arm head is approximately 90° from said ear.

7. The socket of claim 1 wherein said socket housing includes a main portion and a cover; said main portion including said socket housing first end wall, and at least a part of said side wall; said cover including said socket housing second end wall; said cover and main portion being matingly connected.

8. The socket of claim 7 wherein said main portion includes one of a plurality of spring arms and spring arm receptacles, the cover including the other of said plurality of spring arms and spring arm receptacles; said spring arms engaging said spring arm receptacles to connect said cover to said main portion.

9. The socket of claim 8 wherein said spring arm includes an outwardly directed finger; said spring arm receptacles included a slot sized to snappingly receive the spring arm finger and a tab spaced inwardly from said slot to be behind said arm when said cover and body are connected.

10. A lighting fixture base comprising:

a lamp base housing having an outer wall and an end wall, said outer wall and end wall defining a chamber, said chamber being opened at an end opposite of said end wall; said end wall having an opening, the end wall opening including at least one slot; and a ballasted socket mounted in said base housing chamber adjacent an inner surface of said end wall, said socket including:

a socket housing having a side wall, a first end wall, and a second end wall, said walls defining a chamber, the first end wall having a diameter greater than the diameter of the base hosing end wall opening;

a post extending upwardly from said housing first end wall; said post having a side wall and an end wall, said post being sized to extend through the lamp base housing end wall opening;

a spring arm extending generally parallel to said housing first end wall; said spring arm having a fixed end and a free end and a projection near said free end; said projection being sized to engage the slot of the lamp base housing end wall to rotationally fix said socket relative to the lamp housing base with a twisting action;

a socket opening extending inwardly from said socket housing first end wall, said socket opening being sized and shaped to receive a base of a compact fluorescent bulb;

electrical contacts positioned in said socket to electrically engage electrical contacts of the fluorescent bulb; and a ballast in said socket housing chamber, said ballast being electrically connected to said socket contact.

11. The lighting fixture base of claim 10 wherein the socket includes at least one ear extending outwardly from said post side wall, said ear being sized to extend through said slot in said base housing end wall.

12. A lighting fixture base comprising:

a lamp base housing having an outer wall and an end wall, said outer wall and end wall defining a chamber, said chamber being opened at an end opposite of said end wall; said end wall having an opening, the end wall opening including at least one slot; and a ballasted socket mounted in said base housing chamber adjacent an inner surface of said end wall, said socket including:

a socket housing having a side wall, a first end wall, and a second end wall, said walls defining a chamber, the first end wall having a diameter greater than the diameter of the base hosing end wall opening;

a post extending from said socket housing first end wall, said post having an end wall and a side wall and being sized to extend through said opening in said base housing end wall;

at least one ear extending outwardly from said post side wall, said ear being sized to extend through said slot in said base housing end wall;

at least one spring arm which interacts with said at least one slot of said base housing to rotationally position said socket in said base housing;

a socket opening in said post end wall; said socket opening being sized and shaped to receive a base of a compact fluorescent bulb;

a ring on said socket housing first end wall which surrounds said post; said ring having an outer diameter greater than the diameter of the base housing end wall opening; said ring having a side wall and an end wall; said post end wall being spaced axially from said ring end wall; said spring arm extending from said ring adjacent the side wall of said post, said spring arm being generally parallel to the end wall of said ring, said spring arm having a fixed end, a free end, and a head at said free end, said head being sized to be received in said slot of said base housing end wall;

electrical contacts positioned in said socket to electrically engage electrical contacts of the fluorescent bulb; and a ballast in said socket housing chamber, said ballast being electrically connected to said socket contact.

13. The lighting fixture of claim 12 wherein said head is stepped at a back end thereof to define a projection on said spring arm free end, said projection being sized to be snappingly received in said slot of said base housing end wall, said projection creating an interference fit with said slot to prevent inadvertent rotation of said socket relative to said base when said socket is mounted in said base.

14. The lighting fixture of claim 12 wherein said ear has a bottom surface, said ear bottom surface being spaced from said ring end wall by a distance greater than the width of said base housing end wall.

15. The lighting fixture of claim 12 wherein said spring arm is offset from said ear.

16. The lighting fixture of claim 15 wherein said spring arm head is approximately 90° from said ear.

17. The lighting fixture base of claim 11 wherein said socket housing includes a main portion and a cover; said main portion including said socket housing first end wall, and at least a part of said side wall; said cover including said socket housing second end wall; said cover and main portion being matingly connected.

18. The lighting fixture base of claim 17 wherein said main portion includes one of a plurality of spring arms and spring arm slots, the cover including the other of said plurality of spring arms and spring arm slots; said spring arms snappingly engaging said spring arm slots to connect said cover to said main portion.

19. In combination, a lamp base housing and a socket which is received on the lamp base housing;

the lamp base housing including an end wall having an opening and at least one slot extending from said opening; and the socket including a body having an end wall, a post extending up from said end wall and sized to extend through said lamp base housing opening; an ear extending from said post spaced from said socket body end wall and being sized to pass through said lamp base housing slot; and a spring arm on said body; said spring arm having a free end and a fixed end and extending generally parallel to said body; said spring arm free end being circumferentially spaced from said ear; said spring arm extending generally parallel to said body end wall and having a projection extending upwardly from said spring arm sized to engage said housing base slot;

whereby, said socket is mounted to said lamp base by passing said post ear through said lamp base slot and rotating said socket until said spring arm projection engages said lamp base slot, such that said post ear is on one side of said lamp base housing end wall and said spring arm is on an opposite side of said lamp base housing end wall.

* * * * *